United States Patent [19]

Boden

[11] 4,236,361

[45] Dec. 2, 1980

[54] PREFABRICATED BUILDING COMPONENTS

[76] Inventor: Joseph Boden, 341 Timer View Dr., Oak Brook, Ill. 60521

[21] Appl. No.: 914,970

[22] Filed: Jun. 12, 1978

[51] Int. Cl.[3] ..... E04C 2/22

[52] U.S. Cl. ..... 52/204; 52/309.7; 52/600; 52/741

[58] Field of Search ..... 52/601, 309.4, 309.8, 52/600, 673, 674, 454, 448–450, 741, 309.12, 309.7, 204

[56] References Cited

U.S. PATENT DOCUMENTS

| | | | |
|---|---|---|---|
| 1,949,220 | 2/1934 | Schick | 52/600 |
| 2,257,001 | 9/1941 | Davis | 52/601 |
| 2,271,929 | 2/1942 | Venzie | 52/601 |
| 3,113,402 | 12/1963 | Butler | 52/326 |
| 3,736,715 | 6/1973 | Krumwiede | 52/601 |

*Primary Examiner*—John E. Murtagh

*Attorney, Agent, or Firm*—McDougall, Hersh & Scott

[57] ABSTRACT

Building components are disclosed which are constructed at a factory and assembled on site. The components include walls employing concrete reinforced steel columns attached to lightweight insulation. The insulation is secured to the columns by use of a wire mesh disposed between columns. Concrete reinforced steel headers are also provided. A roof includes sheet metal decking provided with lightweight insulation and reinforced for rigidity.

8 Claims, 10 Drawing Figures

FIG. 1
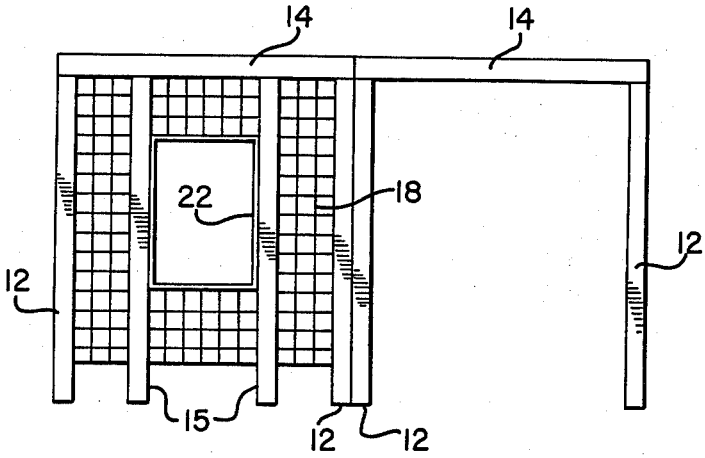
FIG. 2
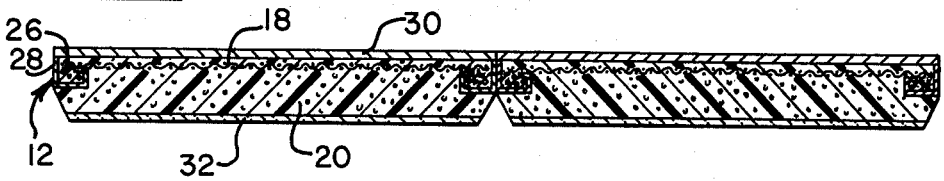
FIG. 3
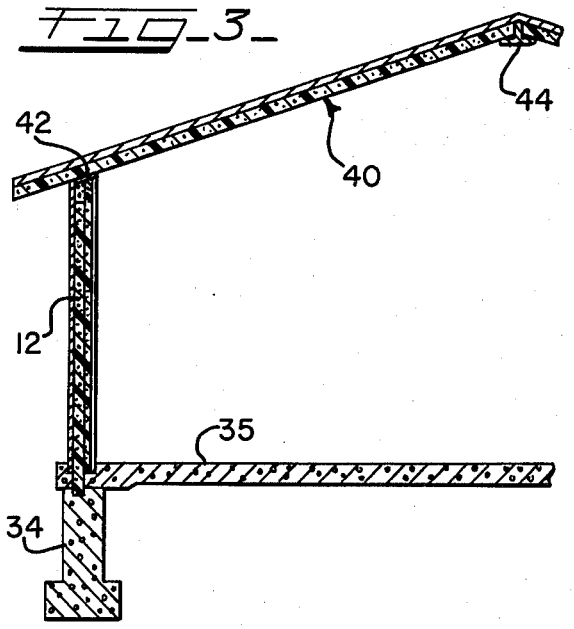
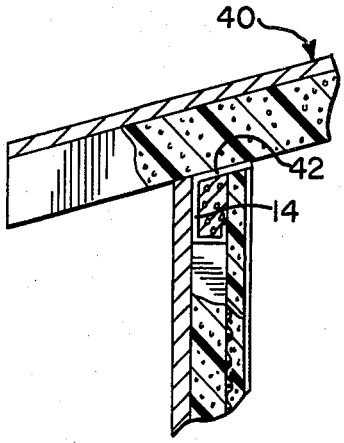
FIG. 3A

PREFABRICATED BUILDING COMPONENTS

BACKGROUND OF THE INVENTION

This invention relates to the field of prefabricated buildings. More specifically, it relates to the provision of prefabricated building components for the construction and assembly of residential and commercial type buildings. It has long been desired to prefabricate buildings so that the economies of assembly line manufacture can be obtained as compared to the high labor cost involved with custom constructed buildings. Many prefabricated building components have been proposed and, indeed, some have found a reasonable measure of success as, for example, the all metal buildings currently being marketed for commercial purposes.

Principal drawbacks of currently available prefabricated building components include their high cost, lack of rigidity, and particularly important under present circumstances, their lack of insulating capability. Metal buildings, for example, are notorious heat wasters and provide only limited possibilities for the provision of additional insulation to reduce the cost of heating such structures.

It is accordingly desirable to provide improved building components from which houses and commercial structures may be formed which are low in cost, easily fabricated in a factory and transported to the construction site and which have excellent thermal retention characteristics. According to the present invention, building components having these desirable characteristics are disclosed.

It is accordingly an object of the present invention to provide building components which provide necessary structural rigidity and load bearing capacity but which are low in cost and may be prefabricated.

A further object of the invention is to provide improved building components which have excellent thermal insulating properties and thus require little or no additional thermal insulation be added during on site assembly.

A further object of the invention is the provision of prefabricated building components which can readily accommodate windows, doors and other special details.

Another object of the invention is to provide lightweight building components formed from reinforced steel columns and lightweight rigid insulation.

Other objects and advantages of the invention will be apparent from the remaining portion of the specification.

SUMMARY OF THE INVENTION

The invention relates to building components which are prefabricated at a factory. A pair of steel columns are positioned horizontally and filled with concrete. Prior to set up of the concrete a wire mesh is installed between the columns. Lightweight insulation is then foamed into the mesh to connect the steel columns forming a rigid lightweight unit. Straight sections and corner units are provided by varying the configuration of the columns. The unit also includes reinforced headers and a sheet metal roof decking system which can be bolted to the walls to form a complete structure.

PRIOR ART STATEMENT

In accordance with 37 CFR § 1.97, the closest prior art of which applicant is aware include the following:

(a) fiberglass-polyurethane building system manufactured by Dura-Plex in which polyurethane is sandwiched between a fiberglass skin.

(b) U.S. Pat. Nos. 4,071,984 to Larrow, 3,927,498 to Benedetti, and 4,065,905 to VanDerlely.

Larrow discloses foam walls to which wood, aluminum, etc., is laminated. Columns are provided for support. Benedetti discloses tubular posts used in conjunction with hollow panels filled with insulating materials. VanDerlely discloses a rectangular panel employing a steel frame.

BRIEF DESCRIPTION OF THE DRAWINGS

FIG. 1 is a front elevational view of wall sections formed according to the present invention.

FIG. 2 is a plan view of the wall sections of FIG. 1.

FIG. 3 is a schematic elevational view illustrating installation of a wall section and the attachment of a roof span thereto.

FIG. 3A is an enlargement of a portion of FIG. 3 showing the interconnection between the roof span and the header.

DETAILED DESCRIPTION

Figure 4:
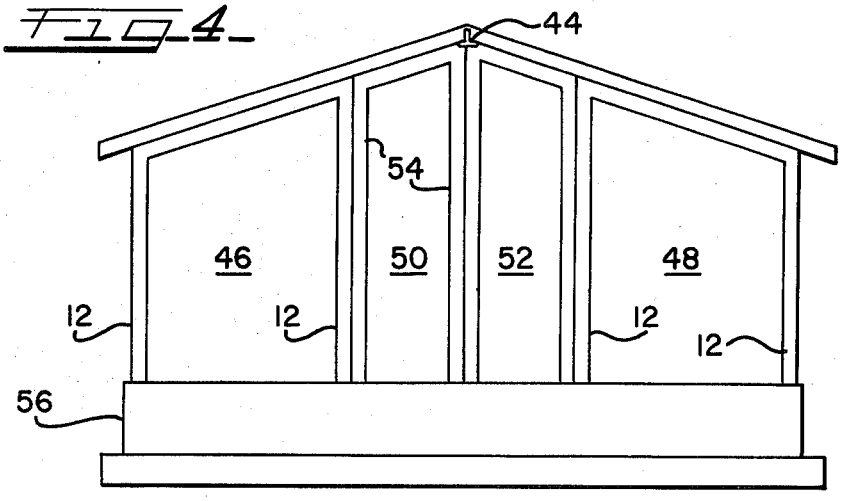
FIG. 4 is a front elevational view of a completed building employing components according to the invention.

Referring now to FIGS. 1 and 2, the wall components of the invention are illustrated. Two wall units are shown each of which includes vertical support columns 12, headers 14, and in the case of the left wall unit, intermediate vertical supports 15. The expanse between the vertical support columns 12 is provided with a wire mesh 18 to which lightweight foam insulation 20 is molded. With respect to the left wall unit, the additional columns 15 permit the positioning of a formed steel frame 22 which is dimensioned to receive an entire window assembly of the conventional type. In a similar fashion, additional vertical supports are provided in the wall units where doors or other special structures are required.

Referring to FIG. 2, the interior construction of the walls may be better understood. The columns 12 are preferably formed of sheet steel reinforced with concrete. Thus, each steel column 12 is shaped to form a trough-like receptacle to receive concrete 26 therein. The specific shape of the steel column will depend to a large extent upon the type of wall section being formed. Thus, in the FIG. 2 embodiment a C-shaped configuration is utilized including an extended tail piece 28 adapted to secure each wall section to an adjacent section in a manner to be described. In the case of corner sections, such as those illustrated in FIGS. 5 and 6, the shape of the steel column is varied to accommodate the requirements of forming a 90° angle.

During the manufacture of each wall unit a wire mesh 18 is positioned between the reinforced steel columns 12. The ends of the mesh are retained by the concrete.

Lightweight insulation is then foamed onto the wire mesh. Once in place the foam, although light in weight and high in installation value, is quite rigid.

As indicated in FIG. 2, the completed units may have an interior wall finish 30 applied over the insulation layer. This is done at the construction site. Such interior wall finish may be plasterboard, wood panelling or the like, as desired. Similarly, an exterior wall finish 32 may be provided which may consist of plywood, brick, plasterboard or similar materials, as desired.

Referring to FIGS. 3 and 3A, the wall construction just described is illustrated in schematic form in conjunction with a foundation and roof deck. As will be described with respect to the manufacture of the wall component according to the invention, the unit is shipped to the building site and then positioned on a conventional concrete foundation 34. To secure the units in position a concrete floor 35 is poured above the foundation around the vertical columns 12 and up to and including the bottom portion of the rigid foam insulation. As shown in FIG. 1, the vertical columns 12 extend beyond the bottom of the wire mesh and foam insulation. The concrete floor 35 extends at least ten inches above the bottom of the upright columns 12 to securely position the wall sections in place.

With respect to FIG. 3A, the detail of the header 14 can be seen with respect to an installation employing a sloped roof span. Like the reinforced columns 12, the header 14 is sheet metal with concrete reinforcement. The header may be attached to the columns 12 in any appropriate manner, as by welding or bolting. Alternately, the header may be formed integrally with the columns 12 as illustrated in FIG. 3A.

The roof span 40 is secured to a metal flange 42 forming the top of the header 14. Depending upon the pitch of the roof, the flange 42 is offset from the horizontal by the appropriate angle. The upper section of the roof 40 is supported on a T-shaped support member 44 secured to opposite walls.

Referring to FIG. 4, the wall and roof elements just described can be seen in a completed structure. Thus, outer panels 46 and 48 and inner panels 50 and 52 form one side of a completed structure. The vertical supports 12 of the outer panels and the vertical supports 54 of the inner panels are secured in the concrete foundation 56. Additionally, each panel is joined to the adjacent panel by bolting or welding in the manner to be described in connection with FIGS. 5 through 7. The roof T member 44 is supported on the double columns 54 of the two center panels 50 and 52.

Figure 5:
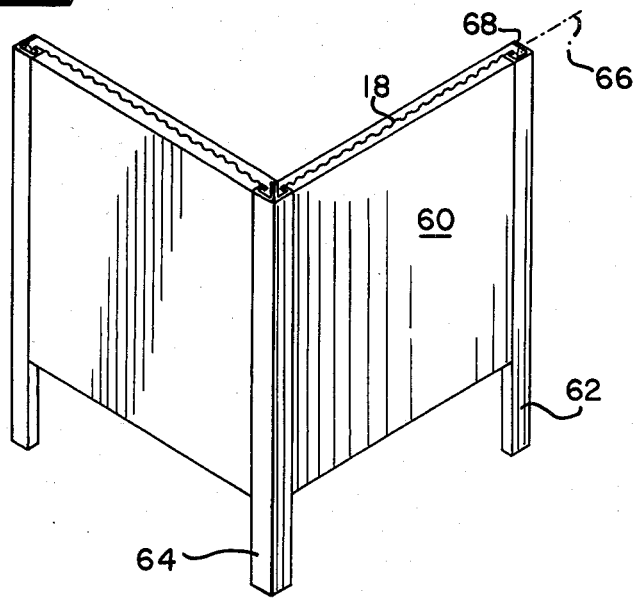
FIG. 5 is a perspective view of wall sections joined to form a corner.
Figure 7:
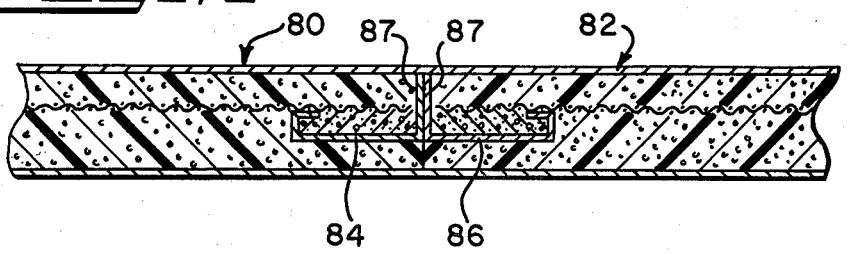
FIG. 7 is a plan view similar to FIG. 6 illustrating the manner of joining two straight wall sections.
Figure 6:
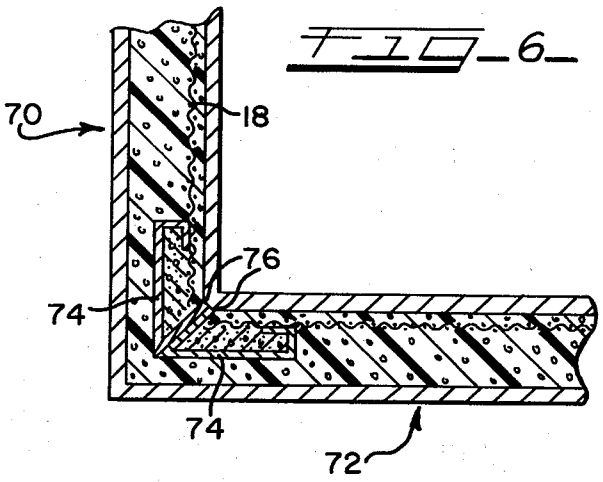
FIG. 6 is a plan view of the sections illustrated in FIG. 5.

Referring now to FIGS. 5 through 7, the method of manufacturing the wall panels according to the invention and the means of joining adjacent panels will be described. As indicated previously, the panels are designed to be prefabricated at a factory by assembly line techniques and then shipped in finished form to the construction site. The individual panels as, for example, panel 60 in FIG. 5, are constructed in a mold in which the columns 62 and 64 are positioned horizontally. When correctly spaced and positioned the columns are filled with concrete to approximately tbe level indicated by the dashed line 66 at the top of column 62 in FIG. 5. This leaves a projecting portion 68 of the column extending above the concrete for the purpose of joining additional panels thereto.

After the concrete has been poured into the columns, the wire mesh 18 is positioned between the columns, the ends thereof being immersed in the soft concrete. After the concrete sets up, the wire mesh is permanently secured to each of the columns. With the columns still in the horizontal position the foam insulation is then molded onto the wire mesh and around the columns to form the composite construction illustrated in FIG. 2. The foam insulation may be styrene, polyurethane, or similar materials. Additionally, it is possible to utilize asbestos or cement aggregates, such as lightweight gypsum materials, although these are not as desirable as the foam insulation just referred to. The composite unit is then removed from the mold and shipped to the construction site. As indicated in FIG. 5, the wire mesh and foam insulation does not extend the full length of the vertical columns 62 and 64. This permits the vertical columns to be inserted into the foundation and then a concrete floor poured around the columns and up to the bottom of the foam wall 60 as best indicated in FIG. 3.

In order to accommodate the various requirements of a given structure, a variety of panel types must be designed. These include straight wall sections which are to be joined to additional straight wall sections, corner sections and special sections having window frames or door frames provided therein. With respect to the special sections additional vertical columns may be required to which the window or door frame is secured as illustrated for the left wall section of FIG. 1.

Referring to FIGS. 6 and 7, the construction details of corner sections and straight sections are illustrated. In FIG. 6 a first wall unit 70 is joined to a similar corner unit 72. The vertical column 74 of each unit constant of a C-shaped receptacle for receiving the concrete reinforcing material and a connecting flange 76. Flanges 76 are offset at 45° angles so that when two wall units are positioned at 90° with respect to each other the flanges butt one against the other with their end portions projecting sufficiently beyond the concrete to permit access to bolt holes provided therein. After the sections are erected at the construction site either temporarily before pouring of the concrete floor or afterward, the flange sections 76 are joined by bolts, rivets, welding or other appropriate manner including clamping in those situations where permanent affixation is not required.

Referring to FIG. 7, two straight wall sections 80 and 82 are illustrated with vertical columns 84 and 86 having flanges 87 extending above the concrete level for the purpose of securing adjacent panels together in the same manner as just described with respect to FIG. 6. In this way a complete structure of the type illustrated in FIG. 4 can be formed by joining straight and corner panel sections together.

Where construction requirements dictate, the columns 12 may have incorporated therein steel reinforcing bars in addition to the concrete aggregate. As indicated previously, after the wall sections have been erected the inside and outside surfaces of the insulation may be covered with any desired wall finishing material, such as wood or aluminum siding, brick, stone, stucco, or plaster, etc.

Figure 8:
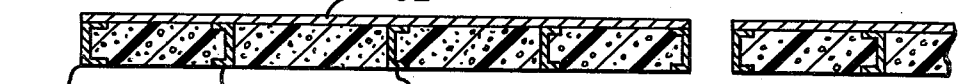
FIG. 8 is a side elevational view of the roof decking according to the invention.
Figure 9:
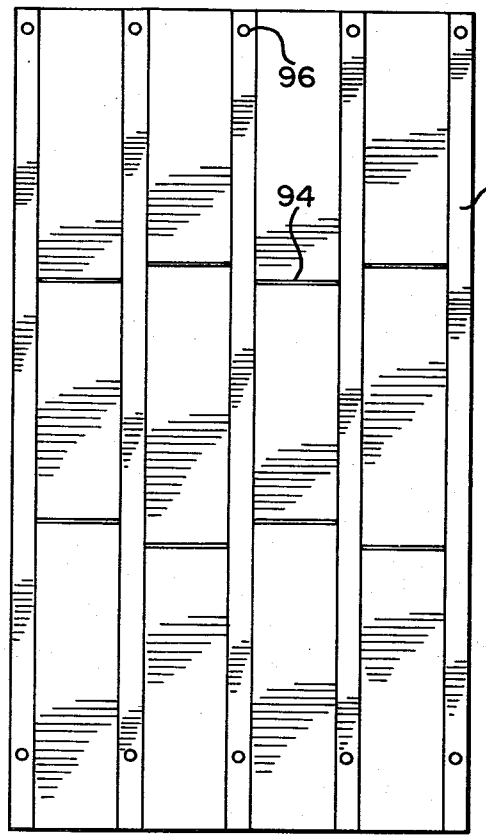
FIG. 9 is a bottom plan view of the roof decking showing the construction details thereof.

Referring now to FIGS. 8 and 9, the construction details of the roof decking components are illustrated. The roof decking includes a plurality of C-shaped sheet metal members 90 to which a decking 92 is secured. The decking may be plywood or sheet metal, as desired. The space between facing members is filled with lightweight foam, such as styrene or polyurethane. After installation the underside of the roof may be covered with an interior sealing finish, such as plaster, gypsum, dry wall, wood, etc. Depending upon the dimensions of the building for which the decking is manufactured, a plurality of sections will be required. The sections are bolted together to form convenient sized modules which are then installed on the wall components previously described.

Referring to FIG. 9, the panels may be periodically reinforced with metal bars 94 to strengthen each roof module prior to the placement of the foam insulation into the panels. A plurality of holes 96 in the bottom portion of the panel members 90 provide means for securing the roof sections in position on the headers as illustrated in FIGS. 3 and 3A. In addition, for a sloped roof, the upper end of the roof panel is secured to the T member 44 which runs the length of the building and is supported on opposing side walls as illustrated in FIGS. 3 and 4.

By means of the present invention it is possible to obtain a superior building structure which may be prefabricated at a factory and shipped to a job site. The building components are strong yet exceptionally light and because the primary material utilized is insulating foam, the heat retention capabilities of the components far surpasses currently available products. A unique feature of the invention is the advantage obtained by increasing the density of the insulating foam whereby its thermal capability is only marginally reduced. Although there is some sacrifice of thermal insulating capability, there is a significant increase in rigidity and the finished units are exceptionally light and strong. The wire mesh, to which the foam is secured and which, in turn, is secured to the vertical supports enhances the aforementioned rigidity.

While I have shown and described embodiments of this invention in some detail, it will be understood that this description and illustrations are offered merely by way of example, and that the invention is to be limited in scope only by the appended claims.

I claim:

1. A prefabricated wall unit for use in building construction comprising:

(a) at least two elongated concrete reinforced support columns, said columns being in spaced parallel relation and each defining a compartment adapted to receive said concrete reinforcement, said columns further including means for joining adjacent wall units together, (b) a wire mesh disposed between said columns in the plane defined by said columns, the ends of said mesh being embedded in the concrete, (c) foam insulating material molded to the wire mesh and filling substantially the entire space between said columns to a thickness of at least approximately the thickness of said columns, said insulation being rigid and lightweight, (d) said unit including additional support columns located intermediate the first two columns, and a metal frame structure attached to said additional columns, said frame permitting the field installation of windows and doors by attachment to said frame.

2. The wall unit according to claim 1 wherein said support columns are formed of sheet metal and said joining means includes a flange portion on each of said columns extending above the level of the concrete reinforcement, said flanges being secured one to the other to join adjacent wall units.

3. A prefabricated wall unit for use in building construction comprising:

(a) at least two elongated concrete reinforced support columns, said columns being in spaced parallel relation and each defining a compartment adapted to receive said concrete reinforcement, said columns further including means for joining adjacent wall units together, (b) a wire mesh disposed between said columns in the plane defined by said columns, the ends of said mesh being embedded in the concrete, (c) foam insulating material molded to the wire mesh and filling substantially the entire space between said columns to a thickness of at least approximately the thickness of said columns, said insulation being rigid and lightweight, said wire mesh and foam insulation terminate at a point above the bottom of said columns, said columns being secured in a building foundation at the construction site.

4. The wall unit according to claim 1 wherein said foam is selected from the group comprising: polyurethane, styrene.

5. A method of fabricating wall units for construction of a site assembled building comprising the steps of:

(a) positioning at least two elongated support columns horizontally in spaced parallel relation, each of said columns defining a compartment for receiving concrete to reinforce said columns, (b) pouring concrete into said column compartments, (c) positioning a wire mesh between said columns in the plane defined by said columns, the ends of said mesh being embedded into said concrete before the latter hardens, (d) molding foam insulating material to said wire mesh to substantially fill the entire space between said columns, (e) said wire mesh and foam insulation terminate at a point above the bottom of said column whereby the columns can be secured in a building foundation at a construction site.

6. The method according to claim 5 further including the steps of:

(e) positioning additional support columns intermediate the first two columns, (f) attaching a metal frame to said additional columns for permitting subsequent field installation of windows and doors by attachment to said frame.

7. A prefabricated building suitable for shipment to and subsequent erection at a building site comprising:

(a) wall units formed from concrete reinforced metal columns having rigid foam secured therebetween on a wire mesh frame, (b) concrete reinforced metal header columms attached to the top of said wall units, (c) insulated roof panels attached to and supported on said headers.

8. The building according to claim 7 wherein said roof panels comprise:

(a) pairs of opposed, elongated, C-shaped metal brackets, (b) metal decking secured to one side of said brackets, (c) insulation disposed in the space between said brackets.

* * * * *